US007159519B2

(12) United States Patent
Robinson et al.

(10) Patent No.: US 7,159,519 B2
(45) Date of Patent: Jan. 9, 2007

(54) SLUG FOR INDUSTRIAL BALLISTIC TOOL

(75) Inventors: Peter W. Robinson, Branford, CT (US); Jack D. Dippold, Edwardsville, IL (US)

(73) Assignee: Olin Corporation, East Alton, IL (US)

( * ) Notice: Subject to any disclaimer, the term of this patent is extended or adjusted under 35 U.S.C. 154(b) by 281 days.

(21) Appl. No.: 10/653,516

(22) Filed: Sep. 2, 2003

(65) Prior Publication Data

US 2004/0200340 A1 Oct. 14, 2004

Related U.S. Application Data

(62) Division of application No. 09/366,586, filed on Aug. 4, 1999, now Pat. No. 6,640,724.

(51) Int. Cl.
*F42B 7/00* (2006.01)
*F42B 8/14* (2006.01)

(52) U.S. Cl. ..... 102/517; 102/501; 102/506

(58) Field of Classification Search ..... 102/506, 102/501, 439, 448, 517; 86/54
See application file for complete search history.

(56) References Cited

U.S. PATENT DOCUMENTS

| | | | | |
|---|---|---|---|---|
| 2,409,307 | A | 10/1946 | Patch et al. | 102/92.5 |
| 2,995,090 | A | 8/1961 | Daubenspeck | 102/91 |
| 3,123,003 | A | 3/1964 | Lange, Jr. et al. | 102/91 |
| 3,232,233 | A | 2/1966 | Singleton | 102/92.5 |
| 3,338,167 | A | 8/1967 | Jungermann et al. | 102/92.7 |
| 3,349,771 | A | 10/1967 | Darigo et al. | 102/91 |
| 3,463,047 | A | 8/1969 | Germershausen | 86/23 |
| 3,570,406 | A | 3/1971 | Frey et al. | 102/92.7 |
| 3,785,293 | A | 1/1974 | Barr et al. | 102/92.7 |
| 3,898,933 | A | 8/1975 | Castera et al. | 102/92.7 |
| 3,951,035 | A | 4/1976 | Dautzenberg et al. | 86/10 |
| 4,428,295 | A | 1/1984 | Urs | 102/448 |
| 4,949,645 | A | 8/1990 | Hayward et al. | 102/517 |
| 4,958,572 | A | 9/1990 | Martel | 102/529 |
| 5,078,054 | A | 1/1992 | Ashok et al. | 102/517 |
| 5,375,529 | A | 12/1994 | Knight, Jr. et al. | 102/513 |
| 5,399,187 | A | 3/1995 | Mravic et al. | 75/228 |
| 5,512,080 | A | 4/1996 | Takahasi et al. | 75/231 |
| 5,527,376 | A | 6/1996 | Amick et al. | 75/228 |
| 5,597,975 | A | 1/1997 | Satow | 102/514 |
| 5,616,642 | A | 4/1997 | West et al. | 524/439 |
| 5,760,331 | A | 6/1998 | Lowden et al. | 102/506 |
| 5,824,944 | A | 10/1998 | Dippold et al. | 102/439 |

(Continued)

FOREIGN PATENT DOCUMENTS

| | | |
|---|---|---|
| GB | 538268 | 7/1941 |

(Continued)

OTHER PUBLICATIONS

Brochure, Ancorsteel 1000: *Atomized Steel Powders for High Performance Powder Metallurgy Applications*, Hoeganaes, pp. 3-19, (1990).

(Continued)

*Primary Examiner*—Michael J. Carone
*Assistant Examiner*—James S. Bergin
(74) *Attorney, Agent, or Firm*—Harness Dickey & Pierce PLC

(57) ABSTRACT

A frangible projectile for expelling from an industrial ballistic tool may be formed by a powder metallurgy process. A preferred embodiment of slug consists essentially of compacted and optionally sintered material and comprises up to 35% ferrotungsten in particulate form, up to 3% lubricant, and the balance iron in particulate form with inevitable impurities.

16 Claims, 12 Drawing Sheets

U.S. PATENT DOCUMENTS

| | | | | |
|---|---|---|---|---|
| 5,831,188 | A | 11/1998 | Amick et al. | 75/246 |
| 5,877,437 | A | 3/1999 | Oltrogge | 75/228 |
| 5,913,256 | A | 6/1999 | Lowden et al. | 75/248 |
| 5,917,143 | A | 6/1999 | Stone | 102/506 |
| 6,038,978 | A | 3/2000 | Harris et al. | 102/467 |
| 6,112,669 | A | 9/2000 | Mravic et al. | 102/501 |
| 6,158,351 | A * | 12/2000 | Mravic et al. | 102/517 |
| 6,248,150 | B1 | 6/2001 | Amick | 102/91 |
| 6,892,647 | B1 * | 5/2005 | Stone | 102/506 |
| 2002/0005137 | A1 * | 1/2002 | Stone | 102/517 |

FOREIGN PATENT DOCUMENTS

| | | |
|---|---|---|
| GB | 965889 | 7/1963 |
| GB | 2278423 | 11/1994 |
| WO | 94/11697 | 5/1994 |
| WO | 97/23760 | 7/1997 |
| WO | 97/27447 | 7/1997 |
| WO | 99/08063 | 2/1999 |

OTHER PUBLICATIONS

ASTM Designation: A 144-73, *Standard Specification for Ferrotungsten* (reapproved 1990).

Brochure, *Powder Metallurgy Grades*, Hoeganaes, (1987).

Brochure, *Standard P/M Molding Powder*, Hoeganaes, pp. 1-8 (date unknown).

* cited by examiner

SLUG FOR INDUSTRIAL BALLISTIC TOOL

CROSS-REFERENCE TO RELATED APPLICATION

This application is a divisional of U.S. patent application Ser. No. 09/366,586, filed on Aug. 4, 1999, now U.S. Pat. No. 6,640,724 issued Nov. 3, 2004, which is incorporated by reference herein in its entirety.

BACKGROUND OF THE INVENTION (1) Field of the Invention

This invention relates to a metallic slug for expulsion from an industrial ballistic tool. More particularly, it relates to a cost-efficient, environmentally friendly, frangible slug.

(2) Description of the Related Art

Industrial ballistic tools are used in a variety of applications. One common application is the in situ cleaning of kilns, for which the tools are commonly identified as kiln guns. Additional applications lie in the tapping and cleaning of furnaces, the cleaning of copper smelters, the cleaning and clearing of silos, the cleaning of boilers, and the like.

By way of example, rotary kilns, which are used to calcine cement and lime, are typically 3 to 7 meters in diameter and 30 to 150 meters long. Calcining takes place at elevated temperatures, typically in the range of 1100° C. to 1500° C. During the calcining process, because of many processing variables, the product may adhere to the sidewall of the kiln forming a clinker, ring or dam. If this adherent obstruction is not removed, additional product will accumulate, reducing or stopping throughput. Removal of the obstruction is necessary.

It is not economically feasible to stop the kiln to remove the obstruction. Also, considering that the ring may form 5 to 10 meters from the end of the kiln, it is not safe or efficient for an operator to attempt to manually remove the obstruction with a long pole or by like methods. Thus many users of rotary kilns utilize industrial ballistic tools. A tool operator will position the tool in a kiln port and then fire metallic projectiles at the obstruction. Impact of the projectiles with the obstruction removes the obstruction from the sidewall of the kiln.

The metallic projectiles are usually formed from lead, a dense material with a relatively low vaporization (boiling) temperature of 1750° C. The lead projectiles knock clinkers from the kiln sidewall and then fall into the kiln and may be vaporized.

Industrial ballistic tools are also utilized by manufacturers of steel, ferrosilicon and other materials. Prior to casting these metals, molten metal is typically contained within an electric furnace sealed by a carbon or clay base plug. Since the molten metal is at a temperature in excess of 2500° C., manual removal of the plug is not feasible. One way that the plug may be removed is with an industrial ballistic tool. A metallic projectile is fired from the industrial ballistic tool to break open the plug, starting the flow of molten metal. To prevent contamination of the metal, the projectile typically is formed of a material such as lead that will vaporize on contact with the molten metal after rupturing the plug. Due to environmental concerns, lead is being phased out as a projectile material for use with industrial ballistic tools. By way of comparison, the use of an exemplary 85 gram lead slug in a kiln or furnace application would introduce up to 85 grams of lead into the atmosphere. Prior to its removal from the U.S. market, a gallon (3.79 l) of leaded gasoline would contain approximately 0.1 grams of lead. Thus each lead slug represents the equivalent of about 3,000 liters (850 gallons) of such leaded gasoline. With the necessity to use many hundreds of slugs per day in certain kiln applications, the amount of lead involved can be significant.

Several substitutes have, to date, proven unsatisfactory. Iron and steel are much harder than lead, causing cast or forged iron or steel-based projectiles to be prone to excessive penetration and ricochet, potentially damaging the kiln and/or injuring the operator. U.S. Pat. No. 3,232,233 of Arthur Singleton discloses iron-based industrial slugs. The slugs are compacted and then sintered at a high temperature. An exemplary such slug is pressed at 414 MPa (30 tons per square inch (tsi) (60,000 psi)) and sintered at a temperature of 982° C. (1800° F.) for a minimum of 45 minutes. To facilitate fragmentation of the slug, it is optionally provided with a compartment or "cavity" to provide a rupture plane. The provision of such cavities adds additional manufacturing complexities and reduces the mass associated with a given overall size or envelope of a projectile.

Zinc and zinc alloys have also been utilized as lead substitutes. Their relatively low density may make them disadvantageous for certain uses. A ballistically stabilized zinc-based projectile is described in U.S. Pat. No. 5,824,944 of Jack D. Dippold et al.

Due to the phasing out of lead-based projectiles, there remains a need for a non-lead-based metallic projectile for use with industrial ballistic tools that does not suffer from the above-stated disadvantages.

Accordingly, it is an object of the invention to provide metallic projectiles for expulsion from an industrial ballistic tool effective to remove clinkers from kilns and/or carbon or clay plugs from electric furnaces.

BRIEF SUMMARY OF THE INVENTION

In one aspect the invention is directed to a method for manufacturing a frangible industrial slug. A mixture of powders is provided having a composition that consists essentially of up to 35% ferrotungsten in particulate form, up to 3% lubricant, and the balance iron in particulate form with inevitable impurities. The mixture is compacted at a pressure of between about 138 MPa (20,000 psi) and about 827 MPa (120,000 psi) to form a compact. The compact is optionally sintered at a temperature no greater than about 900° C.

In another aspect, the invention is directed to a frangible projectile for expelling from an industrial ballistic tool. A projectile consists essentially of a slug which consists essentially of a compacted and sintered material comprising up to 35% ferrotungsten, up to 3% lubricant and the balance iron with inevitable impurities. Frangibility is preferably achieved without the need for frangibility-enhancing bores and compartments, thus not compromising projectile mass and providing a frangibility characterized more by pulverization than by fragmentation. As distinguished from the residual porosity which may be inherent in a powder metallurgical process, such bores and compartments are deliberately placed (such as by machining or molding) and dimensioned to substantially increase frangibility.

In various embodiments of the invention, the ferrotungsten powder may have a particle size distribution such that at least about 40% of such powder can pass through a 100 mesh sieve having a characteristic opening of 0.15 mm. The iron powder may have a particle size distribution such that at least 80% can pass through the sieve. Preferably all of the iron powder can pass through a second 60 mesh sieve having a characteristic opening of 0.25 mm. In various embodiments, the iron powder may have a particle size distribution such that at least about 85% can pass through a 100 mesh sieve. In various embodiments, from 20 to 25% of the iron powder can pass through a sieve having the characteristic opening of 0.045 mm.

Advantageously, the compacting is performed at a pressure effective to provide the compact with a transverse rupture strength in excess of 5.5 MPa (800 psi), and, more preferably, in excess of 7.24 MPa (1050 psi). In various embodiments, the sintering of the compact is performed for a sintering time of from about 1 minute to about 2 hours at a sintering temperature of about 500° C. to 900° C.

Preferably the compacting and optional sintering are effective to provide the slug with sufficient frangibility that, when the slug is expelled from the tool at a muzzle velocity of 640–700 m/s (2100–2400 fps) and normally impacted with a non-armor steel plate having a yield strength of about 310 MPa (45,000 psi) at a distance of about 16 m (53 ft.) from the muzzle, on average a largest residual piece of the slug represents less than 70% of the slug mass and at least 25% of the slug mass is represented by pieces which pass through a 0.084 cm (0.033 inch) sieve. In various embodiments, similar properties may be desired when the muzzle kinetic energy is between about 9,500 N-m (7,000 ft.-lbs.) and about 10,400 N-m (7,700 ft.-lbs.), and the slug is fired from a distance of about 3 meters to about 20 meters.

High degrees of pulverization and minimizing the size of the largest residual piece are desirable. In various embodiments, the largest residual piece may be no more than 5% of the slug mass while the slug is substantially pulverized. In various embodiments, the largest residual piece may be no more than 50% of the slug mass and at least 40% of the slug mass is represented by pieces which pass through a 0.084 cm (0.033 inch) sieve.

Preferably the slug is dimensioned to be expelled from an 8-gauge tool. In various embodiments, such a slug may have a weight of between about 42.5 g (1.5 oz.) and about 65.2 g (2.3 oz.). More preferably, the weight may be between about 48.2 g (1.7 oz.) and about 59.5 g. (2.1 oz.). The material may preferably have a density of between 5.6 and 6.2 g/cc and, more preferably between 5.8 and 6.0 g/cc. In certain embodiments, when a slug is drop weight tested throughout a range of energies between 40 percent and 80 percent of 11,400 N-m, a largest intact residual piece of said slug typically constitutes no more than 70 percent of the slug mass.

Among the advantages of the invention is the provision of a slug which reduces or eliminates the introduction of toxic pollutants (e.g., lead) into the atmosphere. The invention further facilitates the provision of such a slug having sufficient mass, momentum, and kinetic energy when expelled from an industrial ballistic tool to perform effectively in a particular industrial application. The invention further facilitates the provision of the slug having a desired degree of frangibility, such frangibility effective to avoid ricochet and avoid significant damage to the surface of the kiln, furnace, silo or the like at which the expelled slug is directed. The metallic projectile may optionally include a relatively soft sleeve suitable for engaging the rifling of a ballistic tool barrel extension.

Projectiles with the high degree of frangibility facilitated by the present invention may find use in a variety of industrial applications for which conventional industrial slugs may not be advantageous. Where the frangibility allows the projectile to be largely pulverized upon impact (rather than merely fragmented into a modest number of discrete pieces), risk of ricochet is reduced and the projectiles may be useful over a wide range of angles of incidence.

An exemplary application involves the cleaning of accumulations from ladles used in the steel industry. In such an application a slug with insufficient frangibility may hit the ladle at a rather low angle of incidence and may be redirected by the ladle potentially risking injury to personnel and damage to equipment.

Another example involves the clearing of screens used in the mining industry. In the mining industry, heavy screens are often used to block large pieces of material (typically rock) from damaging equipment. In one exemplary situation, a loader is used to deliver material to a crusher which may be located at the bottom of a hole or pit. The loader drops the material into the hole whereupon the material encounters a screen. Small pieces of material fall through the screen while larger pieces remain atop the screen. An exemplary screen is formed of steel bars having an approximate 8×13 cm (3×5 inch) cross-section and arrayed in a mesh defining holes approximately 36×36 cm (14×14 inches). The pieces which are small enough to fall through the screen are then crushed in the crusher and may be delivered back up to the opening of the hole via a conveyor. Instead of the prior practice of lowering a worker into the pit to manually break-up the pieces trapped by the screen, the worker may use an industrial ballistic tool located proximate the opening of the hole to break-up the trapped pieces by impacting them with industrial projectiles.

These and other aspects of the present invention will be readily apparent upon reading the following detailed description of the invention, as well as the drawing and the claims.

BRIEF DESCRIPTION OF THE DRAWINGS

Like reference numbers and designations in the several views indicate like elements.

DETAILED DESCRIPTION

Figure 1:
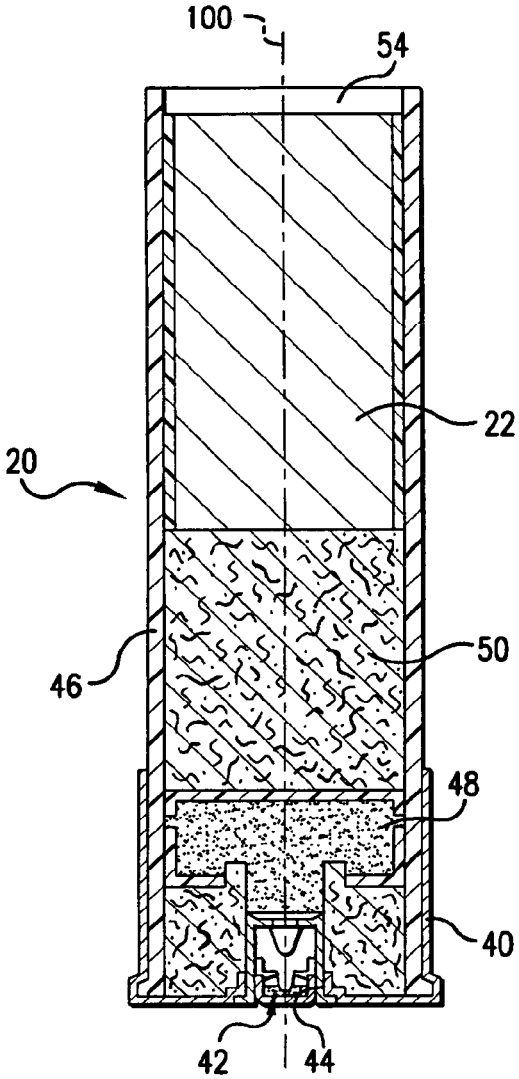
FIG. 1 is a longitudinal cross-sectional view of a cartridge having a slug in accordance with the principles of the invention.
Figure 2:
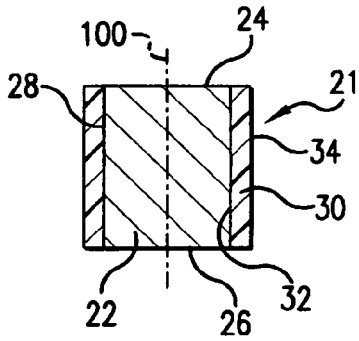
FIG. 2 is a longitudinal cross-sectional view of the slug of FIG. 1.

FIG. 1 shows an exemplary cartridge 20 including a projectile 21 (FIG. 2) containing an industrial slug 22. The cartridge and slug are generally symmetrical about a central longitudinal axis 100. In the exemplary embodiment, the slug 22 is formed as a right circular cylinder having flat circular fore and aft faces 24 and 26, respectively, and a cylindrical lateral surface 28 extending therebetween. To facilitate feeding, the slug may be chamfered at the perimeters of the fore and aft faces. In the exemplary embodiment, the slug 22 has a length between the faces 24 and 26 of 2.54 cm (1.000 inch)+/−0.13 cm (0.050 inch) and a diameter of 1.98 cm (0.780 inch)+/−0.13 cm (0.050 inch) for a volume of about 7.83 cubic centimeters (0.478 cubic inches). The exemplary chamfer is 0.13 cm (0.05 inch) longitudinally and radially. The slug 22 has an exemplary mass of 47.0 grams (1.66 ounces) for a resulting density of about 6.0 grams per cubic centimeter.

Other shapes and dimensions may alternatively be used. The projectile 21 optionally further includes a soft obturating sleeve 30 preferably formed of a plastic material, such as high-density polypropylene, laterally surrounding the slug 22. The sleeve 30 has an inner cylindrical surface 32 which, with the sleeve installed on the slug, has a like diameter to that of the surface 28 in force fit therewith. The sleeve has an outer cylindrical surface 34 which, in such installed condition, has a diameter of about 2.1 cm (0.825 inch). This outer diameter, in combination with the deformability of the sleeve, is effective to allow the sleeve to be engraved by rifling of the ballistic tool from which the slug is expelled, imparting the slug with a desired spin rate about the central longitudinal axis 100. Such outer diameter and physical properties are also advantageously effective to form a seal with a bore of the tool, preferably both along a smoothbore portion (if any) and a rifled portion (if any), forming a substantially gas-tight seal with such smoothbore portion and/or the land and groove surfaces of such rifled portion. Engagement between the sleeve 30 and slug 22 is advantageously sufficient to transmit torque between the sleeve and slug so that they rotate together as a unit at the rifling-induced spin rate. The sleeve 30 has a length which, in the illustrated embodiment, is approximately the same as the length of the slug 22.

The cartridge 20 includes at its aft end a metallic base cap 40 which carries a cap-type primer 42 press fit in a cylindrical pocket 44. A cylindrical plastic or paper tube 46 extends forward from the base cap 42 substantially forming a sidewall of the cartridge. An aft portion of the exterior surface of the tube 46 is in contact with the interior surface of the base cap 40 and may optionally be secured thereto such as via adhesive. An aft region of the tube 46 extending forward from the base cap 40 and in communication with the primer 42 contains a propellant charge 48. Forward of the primer, wadding 50 is provided in a mid-portion of the cartridge. The wadding 50 is generally cylindrical and may be formed of paper or plastic to absorb and dampen the force applied by ignition of the propellant charge 48 to the projectile 22. The wadding may also assist in sealing the bore of the barrel of the tool when the slug is fired. A forward face of the wadding is engaged to the aft face 26 of the slug. The slug is held in a forward region of the cartridge slightly recessed from the fore end of the cartridge. At the fore end of the cartridge, a crimp 54, formed by crimping the tube 46, engages the fore face 24 of the slug to longitudinally retain the slug within the cartridge until the cartridge is fired.

Figure 3:
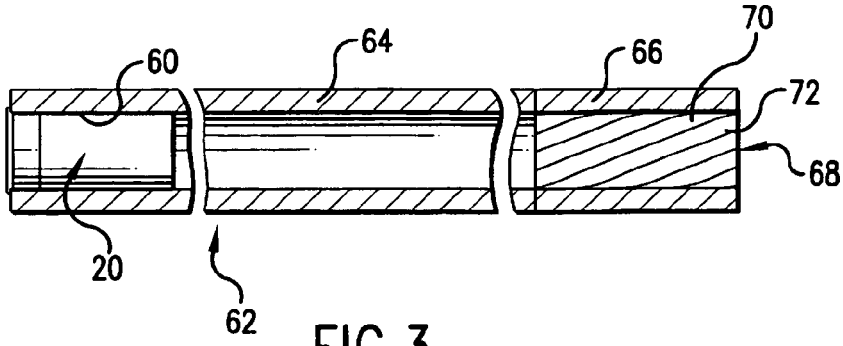
FIG. 3 is a longitudinal cross-sectional view of the cartridge of FIG. 1 chambered in an industrial ballistic tool.

FIG. 3 shows the cartridge 20 in the chamber 60 of an industrial ballistic tool 62. In an exemplary configuration, the tool 62 has a barrel including a smoothbore tube section 64 extending forward from the chamber 60 and an optional rifled extension 66 extending from the smoothbore section 64 to the muzzle 68. The extension 66 includes rifling having lands 70 and grooves 72 shown with an exemplary right hand twist. In the exemplary embodiment, the barrel has an overall length from the chamber to the muzzle of about 1 meter (3 feet) of which about 18–25 cm (7–10 inches) is due to the rifled extension 66. In the illustrated embodiment, the rifled extension has a land-to-land diameter of about 2.05 cm (0.808 inch) and a groove-to-groove diameter of about 2.11 cm (0.830 inch) as is appropriate for use with an eight-gauge projectile. In the exemplary embodiment, the rifling has a gain twist of between about 76 cm and about 102 cm (30 inches and 40 inches). Other tool configurations and sizes may be utilized.

In a preferred method of manufacture of the slug 22, a desired proportion of iron powder, ferrotungsten powder (if any), and lubricant (if any) are mixed to form a homogeneous mixture. Advantageous concentrations of ferrotungsten are up to about 35 percent and of lubricant up to about 3 percent. There may be inevitable impurities which do not substantially affect performance of the slug. Ferrotungsten is an alloy of iron and tungsten which, under standard practice in the metals industry, is an alloy nominally of 80 weight percent tungsten and 20 weight percent iron (see ASTM Designation A144-73, showing grades A–D of ferrotungsten). The invention may be practiced with other than standard ferrotungsten. Alloys of about 10–25 percent iron content, balance tungsten and impurities should perform equivalently to standard ferrotungsten. The presence of impurities, typically less than 5%, should not degrade performance significantly. The various processes may be adapted for use with iron-tungsten alloys of yet different proportion. For purposes of reference, the term iron powder shall mean a powder, the particles of which have an iron content in excess of 95 percent. As used in the specification and claims, all composition percentages are weight/mass percentages unless specifically noted. The lubricant functions to enhance flow of the powder under compaction and reduce friction between the compacting powder and the tooling (e.g., the die in which the powder is compacted). Reduced friction decreases tooling wear and facilitates ease of release of the compact. Preferred lubricants are synthetic fatty diamide waxes and mixtures of such with other natural or synthetic waxes although stearic acid, zinc stearate, lithium stearate, and the like may potentially be used individually or in mixtures.

Advantageous lubricant concentrations are about 1% by weight, typically less, preferably less than 2% and with no need foreseen to exceed 3%.

The desired quantity of the mixture is compacted in a die substantially at a compaction pressure and for a compaction time so as to form a "green" compact (e.g., prior to any sintering or thermal delubing at a temperature below that required to sinter). Advantageous compaction pressures are from about 138 MPa (20,000 psi) to about 827 MPa (120,000 psi). Compaction is, for example, performed with a cylindrical die and with one or two rams or pistons impacting the mix in the die from one or both ends of the die. Compacting times are thus brief (e.g., on the order of a fraction of a second). At a given compaction pressure, the die configuration, including whether the die is a single or dual ram type will influence the properties of the ultimate slug. Thus experimentation may be required to achieve a given result with a given compaction apparatus.

The green slug may not have the same physical properties as desired for the ultimate slug if no further processing is to be done. However, the green slug has sufficient strength so that automated handling equipment preparing the green slug for such further processing will not damage the green slug (e.g., fragment the slug and/or deform the slug, which might impose the costs of additional finish machining to address the resulting deformations). One strength parameter suitable for characterizing the resistance to handling damage is transverse rupture strength. A low transverse rupture strength will require careful and delicate handling. For ease of handling, a preferred minimum of transverse rupture strength is 5.5 MPa (800 psi) while a more preferred minimum would be 6.9 MPa (1000 psi). A range of transverse rupture strength between about 7.24 MPa and about 8.62 MPa (1050 and 1250 psi) is believed to correspond to certain preferred compositions. Higher values of transverse rupture strength are not regarded as disadvantageous unless the compacting were at such extreme pressure as to reduce frangibility of the ultimate projectile.

An optional delubing step may follow the compacting step. The green slug is delubed by heating it at a delube temperature for a delube time effective to substantially evaporate the lubricant from the green slug. Advantageous ranges of delube temperature are from about 500° C. to about 700° C. and of delube time from about 5 minutes to about 45 minutes.

An optional sintering step may follow the compacting step or the delubing step. If not already delubed, the sintering step would typically be effective to delube the slug. The sintering is performed at a sintering temperature and for a sintering time. The sintering step will typically provide the slug with its ultimate properties. The sintering is advantageously effective to provide the ultimate slug with sufficient strength to withstand expelling from the industrial ballistic tool while leaving the slug with a desired degree of frangibility. A preferred sintering temperature range is from between about 500° C. to about 900° C. An associated preferred sintering time is from about 1 minute to about 2 hours with the shorter sintering times being associated with the higher sintering temperatures. The sintering need not be performed at a single temperature during the entire sintering time. A more preferred upper limit on the temperature range is about 750° C. and an associated lower limit on sintering time is about 4 minutes.

EXAMPLES

Table 1 shows manufacturing parameters for a series of exemplary slugs.

TABLE 1

| | Mixture (wt. %) | | | Density (g/cc) | | Sintering | |
|---|---|---|---|---|---|---|---|
| Ex. | Fe* | FeW | Lub.** | Green (avg.) | Sint. (avg.) | Temp. (° C.) | Time (min.) |
| 1 | 99.2 M | 0.0 | 0.8 A | 6.01 | 5.98 | 650 | 15.0 |
| 2 | 99.2 A | 0.0 | 0.8 A | 6.65 | 6.60 | 650 | 15.0 |
| 3 | 69.0 G | 30.0 | 1.0 K | 7.29 | 7.22 | 650 | 15.0 |
| 4 | 99.4 G | 0.0 | 0.6 C | 6.94 | N/A | N/A | N/A |
| 5 | 99.8 G | 0.0 | 0.2 A | 6.15 | 6.14 | 650 | 15.0 |
| 6 | 89.0 G | 10.0 | 1.0 K | 6.63 | 6.60 | 650 | 15.0 |
| 7 | 49.0 G | 50.0 | 1.0 K | 7.87 | 7.78 | 650 | 15.0 |
| 8 | 99.8 B | 0.0 | 0.2 A | 6.11 | 6.09 | 650 | 15.0 |

*M = MH-100, A = 1000A, B = 1000B, G = 1000G
**A = ACRAWAX C, K = KENOLUBE, C = CERACER 640X83
N/A = Not Applicable A variety of specific iron types and grades may be used as may be different power metallurgy lubricants. Exemplary iron may be obtained from Hoeganaes Corporation, of Riverton, N.J. including the ANCORSTEEL 1000 Series (1000(1000A), 1000B, and 1000C) water-atomized iron which has a globular morphology and ANCOR MH-100 oxide-reduced iron which has a dendritic or sponge-like morphology. Properties of the exemplary water-atomized powders are described in the Hoeganaes Corporation publication "Ancorsteel 1000 1000B 1000C Atomized Steel Powders For High Performance Powder Metuallary Applications", April, 1990, the disclosure of which is incorporated herein by reference in its entirety. Exemplary lubricants are of the synthetic and natural wax type and include those sold under the trademarks: ACRAWAX C, available from Lonza of Fair Lawn, N.J.; KENOLUBE a mixture of synthetic fatty diamide wax and zinc stearate available from Hoeganaes Corporation of Riverton, N.J.; and CERACER 640X83, available from Shamrock Technologies, Inc. of Newark, N.J. Table 2 shows exemplary particle size distribution for various of the iron and ferrotungsten powders utilized. The ferrotungsten powder was sequentially sifted through sieves having characteristic openings of 600, 425, 250, 150, 75 and 45 μm. For the iron powders, only 150 and 45 μm sieves were utilized.

TABLE 2

| Sieve | | Percent on Sieve for Powder Indicated | | | |
|---|---|---|---|---|---|
| Mesh | Opening (μm) | MH100 Iron | 1000B Iron | 1000G Iron | FeW |
| 30 | 600 | 0 | 0 | 0 | 0 |
| 40 | 425 | — | — | — | 10 |
| 60 | 250 | — | — | — | 22 |
| 100 | 150 | 8.0 | 14.5 | 6.8 | 17 |
| 200 | 75 | — | — | — | 19 |
| 325 | 45 | 72.1 | 64.5 | 70.1 | 17 |
| Pan | — | 19.9 | 21.0 | 23.1 | 15 |

Figure 4:
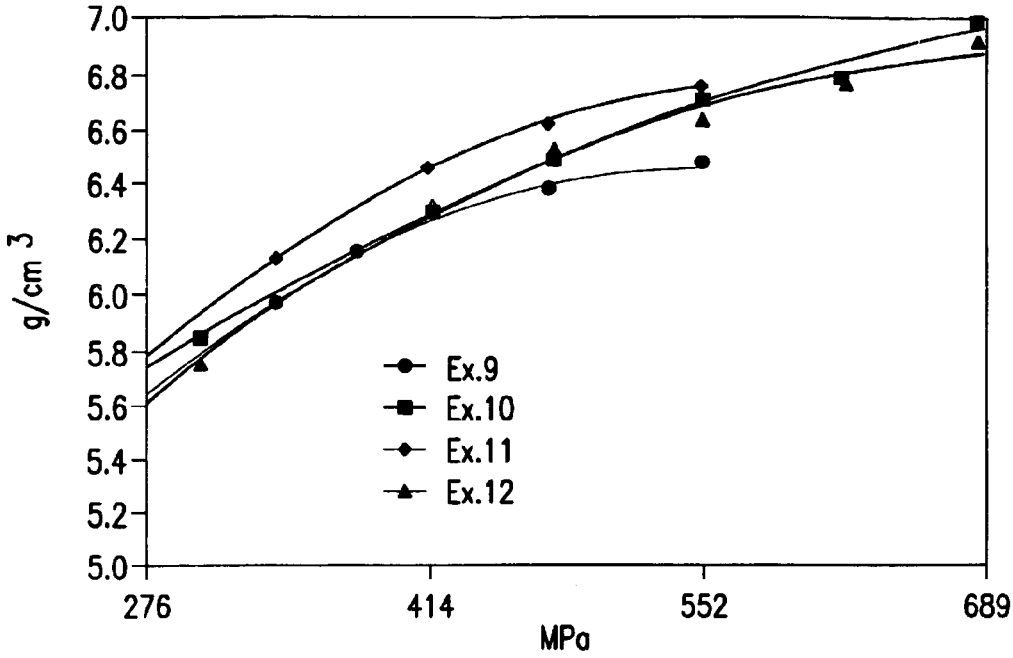
FIG. 4 is a graph of green density vs. compaction pressure for four mix compositions.

The green properties of the slugs will depend upon the composition and compaction pressure. FIG. 4 is a graph of green density vs. compaction pressure for four mixes consisting of 1000B iron and a lubricant. The four compositions designated examples 9–12 include 0.2, 0.5, and 0.8 percent ACRAWAX C, and 0.8 percent CERACER 640X83, respectively.

Figure 5:
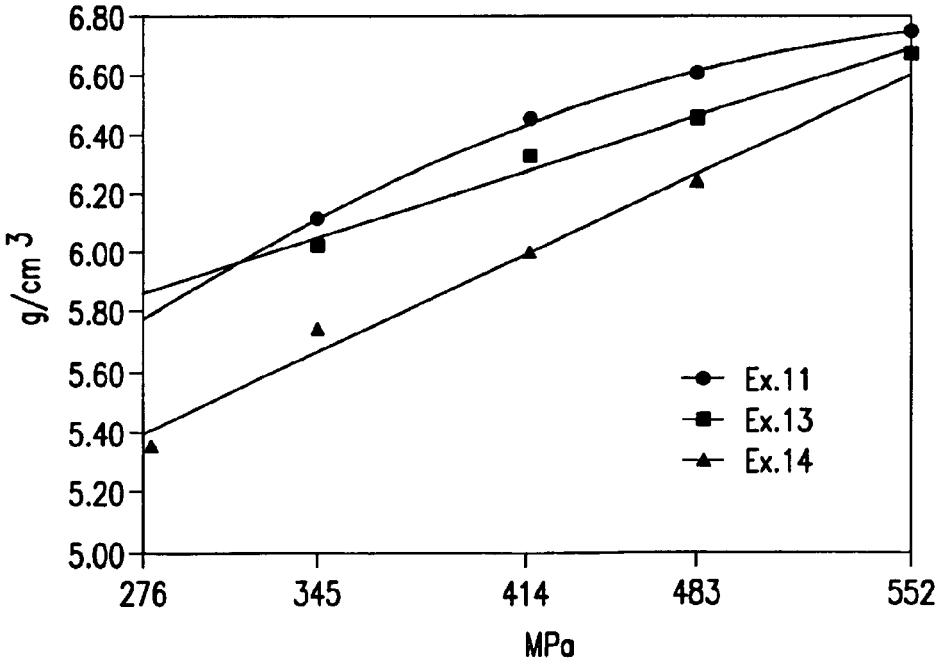
FIG. 5 is a graph of green density vs. compaction pressure for three different iron powders with a single lubricant.
Figure 6:
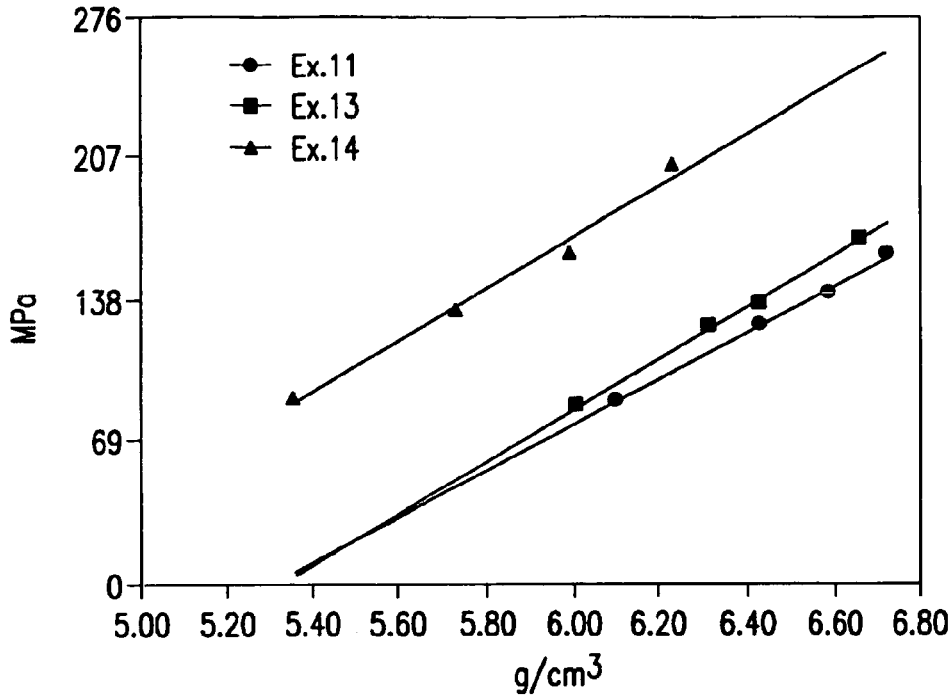
FIG. 6 is a graph of green strength vs. green density for the compositions of FIG. 5.

FIG. 5 is a graph of green density vs. compaction pressure for compositions consisting of 0.8 percent ACRAWAX C and the remainder respectively 1000B (Ex. 11), 1000(1000A) (Ex. 13) and MH-100 (Ex. 14) iron powders. FIG. 6 is a graph of green strength (measured as axial crush strength on cylinders) vs. green density for the three compositions of FIG. 5.

Figure 7:
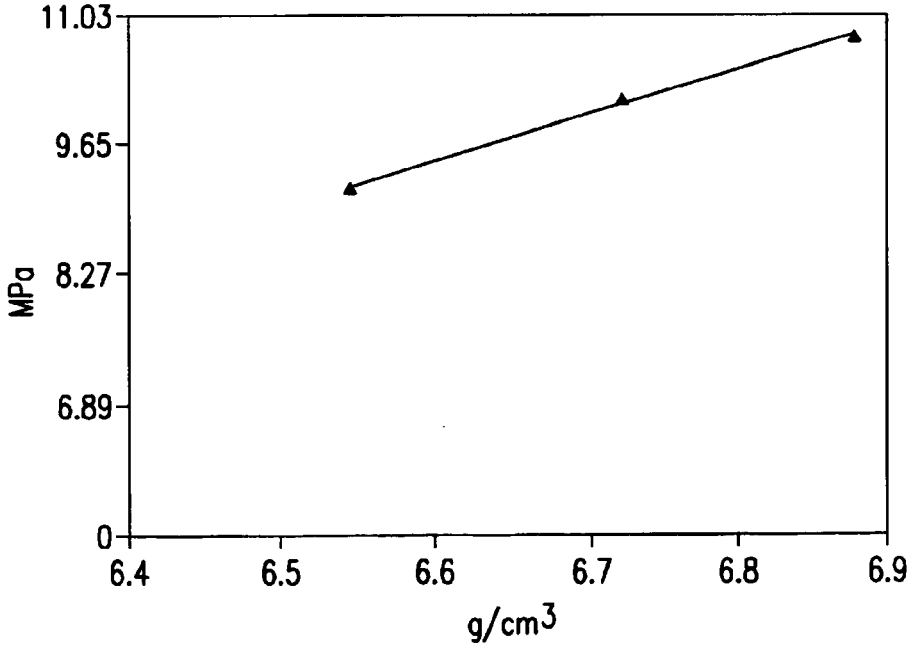
FIG. 7 is a graph of three point bend strength vs. green density for a single mix.

FIG. 7 is a graph of green strength (measured as three point bend strength) vs. green density for a mixture of 1000B iron and 0.8 percent ACRAWAX C.

Drop weight tests were performed to provide an indication of projectile frangibility. When expelled from the tool, a projectile has a kinetic energy associated with its muzzle velocity. Such kinetic energy is one half of the mass of the projectile multiplied by the square of the muzzle velocity. Aerodynamic resistance will slow the projectile somewhat by the time it reaches a target. Furthermore, not all of the projectile's kinetic energy is expended in deforming the projectile when it impacts the target. The remainder of the energy may be expended in deforming the target, the kinetic energy of ricocheting fragments, generating sound and the like. The drop weight tests were provided to simulate the expenditure of different fractions of a kinetic energy on deforming a projectile so as to determine projectile frangibility from such energy expenditure. The reference kinetic energy was chosen as about 7170 N-m (5288 ft-lb.), the kinetic energy of a 56.7 g (2 oz.) slug traveling at 503 m/s (1650 ft/s). The tests were performed by dropping a body having a known weight (w) from a known height (h) onto a material sample, the expended energy being calculated as wh. Due to the high amount of energy required to test an actual slug, the drop tests were performed on cylindrical samples having the same composition and compaction/sintering parameters as the actual slugs but at a diameter of 0.866 cm (0.341 inch), only about 6.2% of the volume of the slugs. The kinetic energy used in the drop weight tests was selected such that the energy density (energy expended per unit sample volume) was the same as for a full size slug at the same fraction of the reference kinetic energy. In the tests both the dropped body and the surface supporting the test samples were formed of unhardened steel.

TABLE 3

| | | | | | | Drop Parameters | | | |
|---|---|---|---|---|---|---|---|---|---|
| | Pressure MPa | Cylinder Size cm (in) | | Density (g/cc) | | Ht. cm | Wt. Kg | Energy Density | Largest Residual |
| Ex. | (tsi*) | Dia. | Length | Green | Sint. | (in.) | (lb.) | (%) | Piece (%) |
| 1 | 386 (28) | 0.866 (0.341) | 0.894 (0.352) | 6.02 | 5.96 | 30.5 (12) | 34.9 (77.0) | 22 | 79 |
| | | 0.866 (0.341) | 0.892 (0.351) | 5.96 | 5.95 | 30.5 (12) | 34.9 (77.0) | 22 | 54 |
| | | 0.866 (0.341) | 0.861 (0.339) | 6.03 | 6.03 | 57.2 (22.5) | 34.9 (77.0) | 42 | 60 |
| | | 0.866 (0.341) | 0.866 (0.341) | 5.98 | 5.95 | 57.2 (22.5) | 34.9 (77.0) | 42 | 63 |
| | | 0.866 (0.341) | 0.864 (0.340) | 6.03 | 6.01 | 57.2 (22.5) | 71.2 (157.0) | 85 | 50 |
| | | 0.866 (0.341) | 0.877 (0.345) | 6.04 | 6.00 | 57.2 (22.5) | 71.2 (157.0) | 84 | 53 |
| 2 | 552 (40) | 0.866 (0.341) | 0.792 (0.312) | 6.64 | 6.57 | 27.9 (11.0) | 34.9 (77.0) | 22 | 63 |
| | | 0.866 (0.341) | 0.800 (0.315) | 6.60 | 6.53 | 27.9 (11.0) | 34.9 (77.0) | 22 | 53 |
| | | 0.866 (0.341) | 0.787 (0.310) | 6.66 | 6.62 | 53.3 (21.0) | 34.9 (77.0) | 43 | 55 |
| | | 0.866 (0.341) | 0.790 (0.311) | 6.68 | 6.64 | 53.3 (21.0) | 34.9 (77.0) | 43 | 52 |
| | | 0.866 (0.341) | 0.782 (0.308) | 6.68 | 6.64 | 53.3 (21.0) | 71.2 (157.0) | 88 | 48 |
| | | 0.866 (0.341) | 0.782 (0.308) | 6.64 | 6.59 | 53.3 (21.0) | 71.2 (157.0) | 88 | 46 |
| 3 | 372 (27) | 0.866 (0.341) | 1.143 (0.450) | 7.31 | 7.25 | 29.2 (11.5) | 34.9 (77.0) | 16 | N/M** |
| | | 0.866 (0.341) | 1.179 (0.464) | 7.22 | 7.13 | 57.2 (22.5) | 34.9 (77.0) | 31 | N/M** |
| | | 0.866 (0.341) | 1.143 (0.450) | 7.35 | 7.28 | 57.2 (22.5) | 71.2 (157.0) | 64 | N/M** |
| 4 | 676 (49) | 0.866 (0.341) | 1.191 (0.469) | 6.95 | N/A | 15.2 (6.0) | 34.9 (77.0) | 8 | N/M** |
| | | 0.866 (0.341) | 1.234 (0.486) | 6.93 | N/A | 29.2 (11.5) | 34.9 (77.0) | 15 | N/M** |
| | | 0.866 (0.341) | 1.219 (0.48) | 6.93 | N/A | 57.2 (22.5) | 34.9 (77.0) | 30 | N/M** |
| | 379 (27) | 0.866 (0.341) | 0.841 (0.331) | 6.10 | 6.06 | 29.2 (11.5) | 34.9 (77.0) | 22 | N/M** |
| | | 0.866 (0.341) | 0.820 (0.326) | 6.20 | 6.23 | 57.2 (22.5) | 34.9 (77.0) | 44 | N/M** |
| | | 0.866 (0.341) | 0.843 (0.332) | 6.14 | 6.14 | 57.2 (22.5) | 71.2 (157.0) | 86 | N/M** |
| 6 | 379 (27) | 0.866 (0.341) | 1.262 (0.497) | 6.60 | 6.59 | 29.2 (11.5) | 34.9 (77.0) | 15 | N/M** |
| | | 0.869 (0.342) | 1.257 (0.495) | 6.63 | 6.60 | 57.2 (22.5) | 34.9 (77.0) | 28 | N/M** |
| | | 0.866 (0.341) | 1.257 (0.495) | 6.66 | 6.60 | 57.2 (22.5) | 71.2 (157.0) | 59 | N/M** |
| 7 | 379 (27) | 0.866 (0.341) | 1.074 (0.423) | 7.85 | 7.76 | 29.2 (11.5) | 34.9 (77.0) | 17 | N/M** |
| | | 0.866 (0.341) | 1.074 (0.423) | 7.79 | 7.71 | 57.2 (22.5) | 34.9 (77.0) | 34 | N/M** |
| | | 0.866 (0.341) | 1.074 (0.423) | 7.96 | 7.87 | 57.2 (22.5) | 71.2 (157.0) | 68 | N/M** |
| 8 | 379 (27) | 0.866 (0.341) | 0.864 (0.340) | 6.08 | 6.13 | 29.2 (11.5) | 34.9 (77.0) | 21 | 69 |
| | | 0.866 (0.341) | 0.856 (0.337) | 6.15 | 6.13 | 29.2 (11.5) | 34.9 (77.0) | 22 | 72 |
| | | 0.866 (0.341) | 0.856 (0.337) | 6.16 | 6.11 | 57.2 (22.5) | 34.9 (77.0) | 42 | 55 |
| | | 0.866 (0.341) | 0.871 (0.343) | 6.06 | 6.02 | 57.2 (22.5) | 34.9 (77.0) | 41 | 50 |
| | | 0.866 (0.340) | 0.881 (0.347) | 6.03 | 6.02 | 57.2 (22.5) | 71.2 (157.0) | 84 | 52 |
| | | 0.866 (0.341) | 0.864 (0.340) | 6.15 | 6.13 | 57.2 (22.5) | 71.2 (157.0) | 85 | 47 |

TABLE 3-continued

| Ex. | Pressure MPa (tsi*) | Cylinder Size cm (in) Dia. | Length | Density (g/cc) Green | Sint. | Drop Parameters Ht. cm (in.) | Wt. Kg (lb.) | Energy Density (%) | Largest Residual Piece (%) |
|---|---|---|---|---|---|---|---|---|---|
| Cont. | 689 (50) | 0.866 (0.341) | 0.744 (0.293) | 7.00 | 6.98 | 29.2 (11.5) | 34.9 (77.0) | 25 | 100 |
| | | 0.866 (0.341) | 0.762 (0.300) | 7.08 | 6.99 | 57.2 (22.5) | 34.9 (77.0) | 49 | 100 |
| | | 0.866 (0.341) | 0.762 (0.300) | 7.06 | 6.99 | 56.4 (22.2) | 71.2 (157.0) | 97 | 100 |

*tons/sq. inch
**Not Measured

As shown in Table 3, the largest residual piece was measured only for examples 1, 2 and 8. This is defined as the percentage of the mass of the original sample represented by the largest single intact piece recovered after performance of the drop test. This is one measure of frangibility, with smaller largest residual pieces indicating higher frangibility which is advantageous to avoid penetration of equipment and ricochet. It is noted that in firing tests, with the exemplary compositions, the largest residual piece would likely be much smaller than in the drop weight test. This is because whereas with a fired slug, only the surface which the slug impacts restrains break-up of the slug, the drop weight test compresses the sample between two opposed surfaces which tend to constrain the break-up of the sample. The control was prepared with a mixture of 99% 1000G iron and 1% KENOLUBE lubricant. The mixture was pressed at 689 MPa (50 tsi), delubed/sintered at 650° C. for 15 minutes and further sintered at 1000° C. for a subsequent 15 minutes. The control remained intact in all drop tests. It is noted that the control does not represent any prior art composition but was prepared to provide a relatively less frangible comparison than the other compositions tested. It is noted that the post sintering density of a green cylinder should theoretically be lower than the green density by an amount associated with the lost lubricant. Departures from this in Table 3 may reflect measurement error.

Figure 8A:
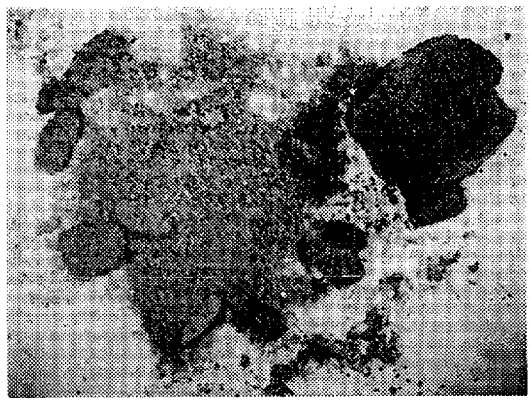
FIGS. 8A–16C are photographs of drop test results for various slug compositions.
Figure 8B:
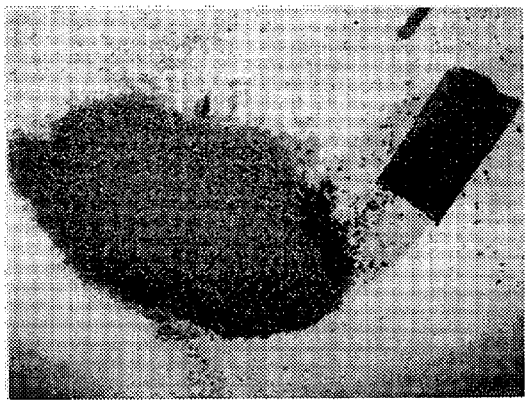
Figure 8C:
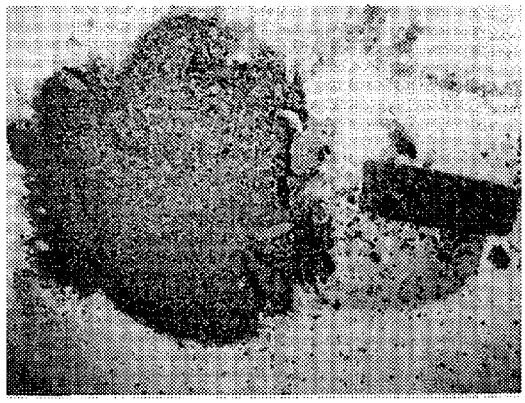

Photographic evidence helps identify the nature of the frangibility. FIGS. 8A–8C are photographs of the sample remnants of the drop test of Ex. 1 at 22, 42, and 84% of the reference energy density, respectively. Although in each case there is one major intact piece, the remainder of the sample is largely pulverized (as distinguished from being ruptured into a series of larger fragments). The absence of larger fragments is evidence of a very high degree of frangibility, such that, in real world use, there is reduced likelihood of any significant fragments remaining intact to dangerously ricochet.

Figure 9A:
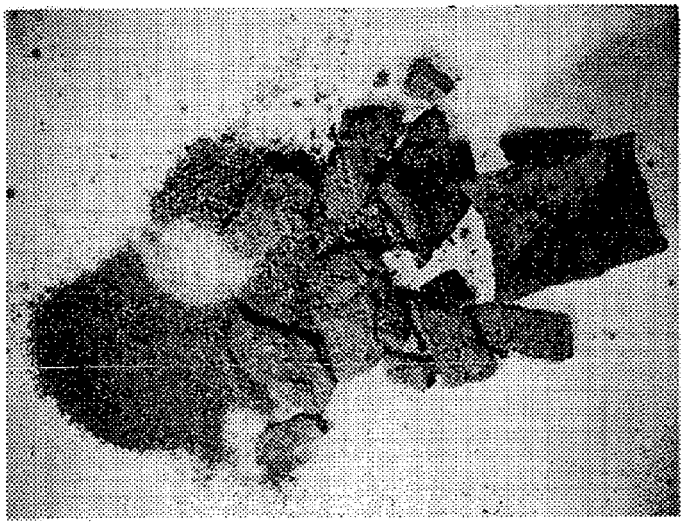
Figure 9B:
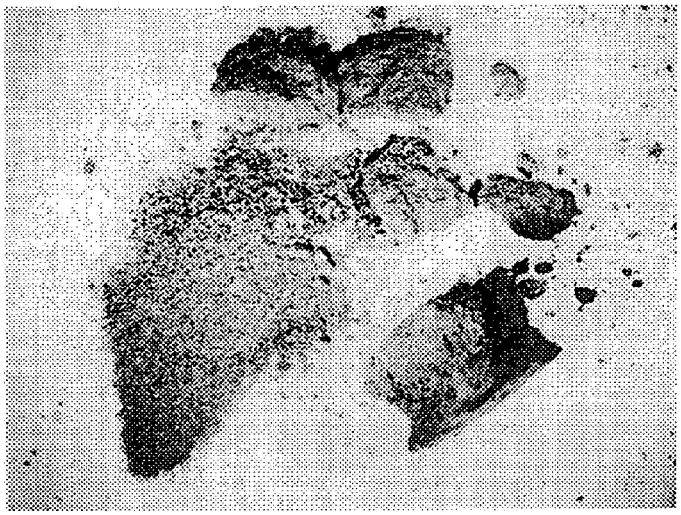
Figure 9C:
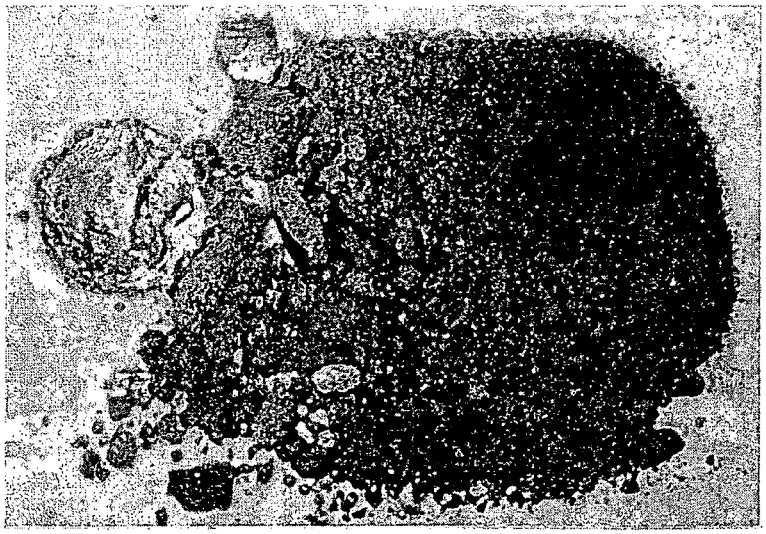

Similarly, FIGS. 9A–9C show the results for Ex. 2 at 22%, 43% and 88% of the reference energy density, respectively.

Figure 10A:
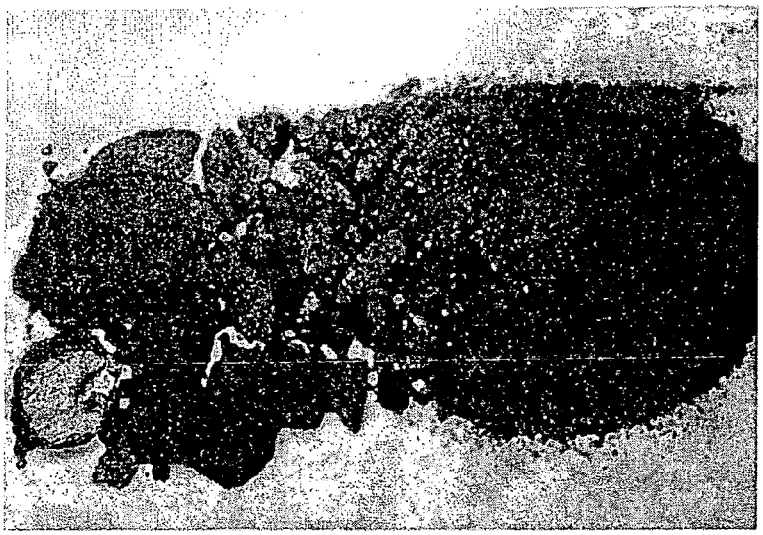
Figure 10B:
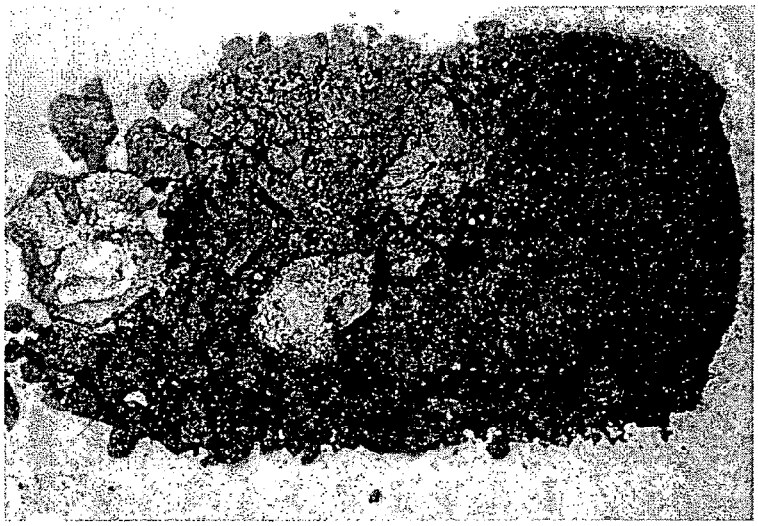
Figure 10C:
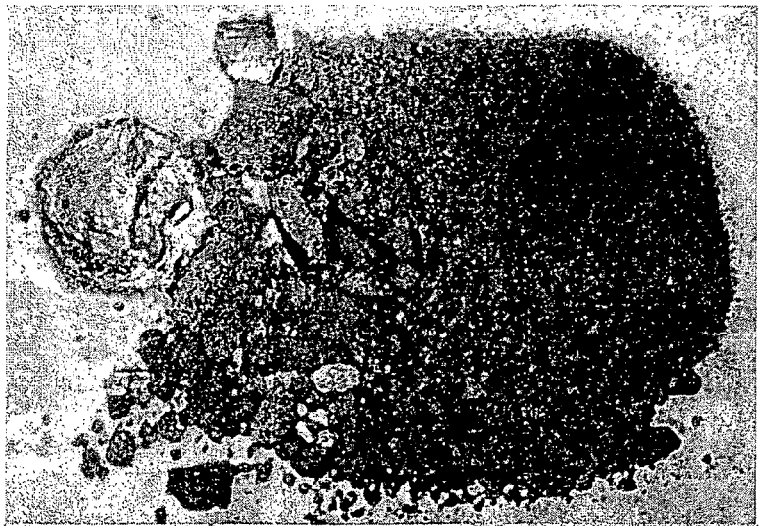

FIGS. 10A–10C show the results for Ex. 3 at 16, 31, and 64% of the reference energy density, respectively.

Figure 11A:
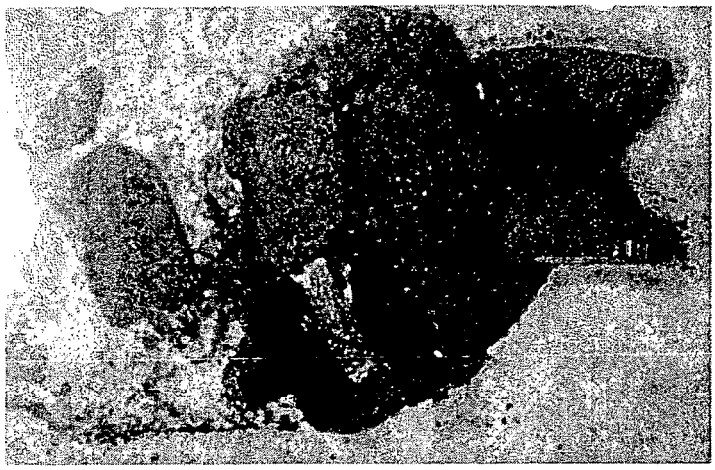
Figure 11B:
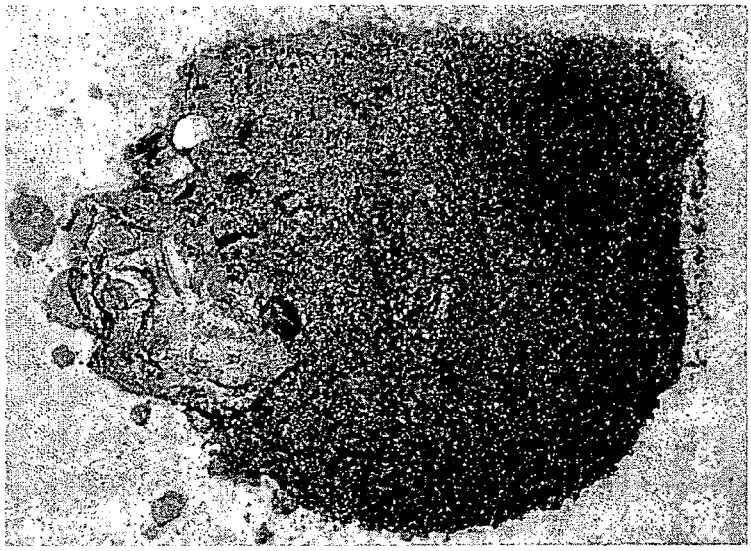
Figure 11C:
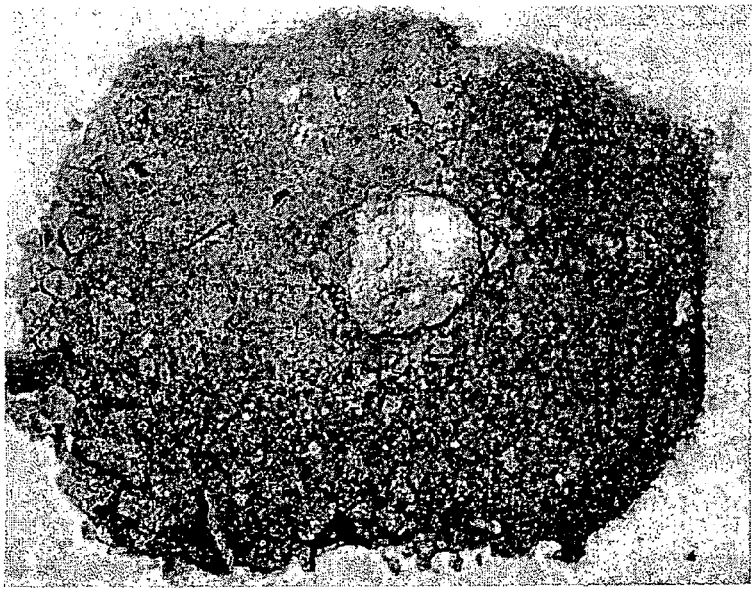

FIGS. 11A–11C show the results for Ex. 4 at 8, 15, and 30% of the reference energy density, respectively.

Figure 12A:
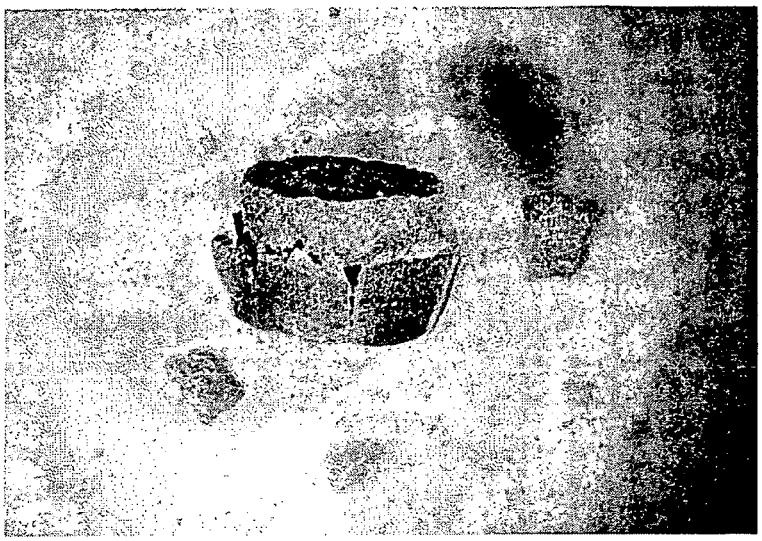
Figure 12B:
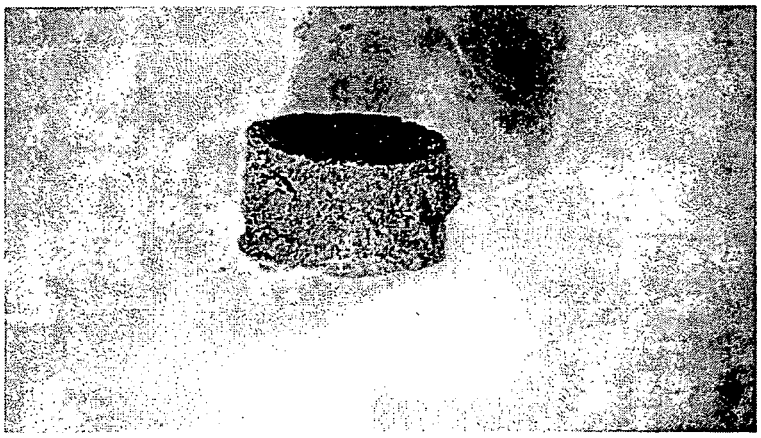
Figure 12C:
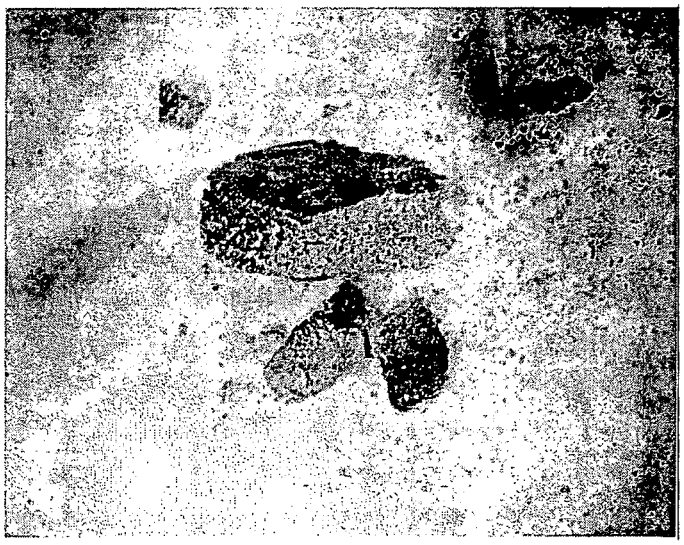

FIGS. 12A–12C show the results for Ex. 5 at 22, 44, and 86% of the reference energy density, respectively.

Figure 13A:
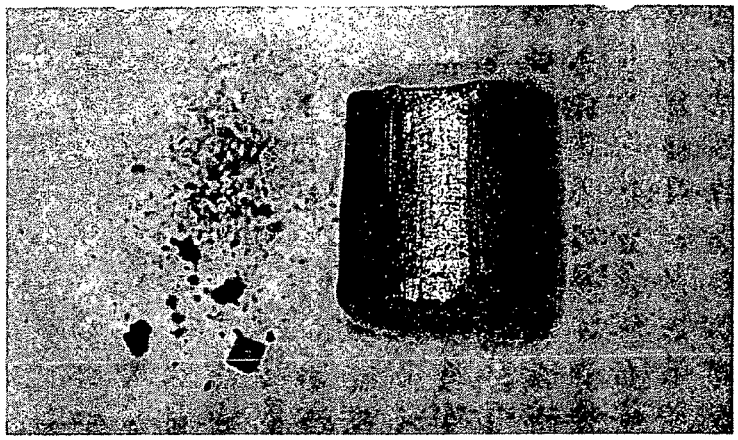
Figure 13B:
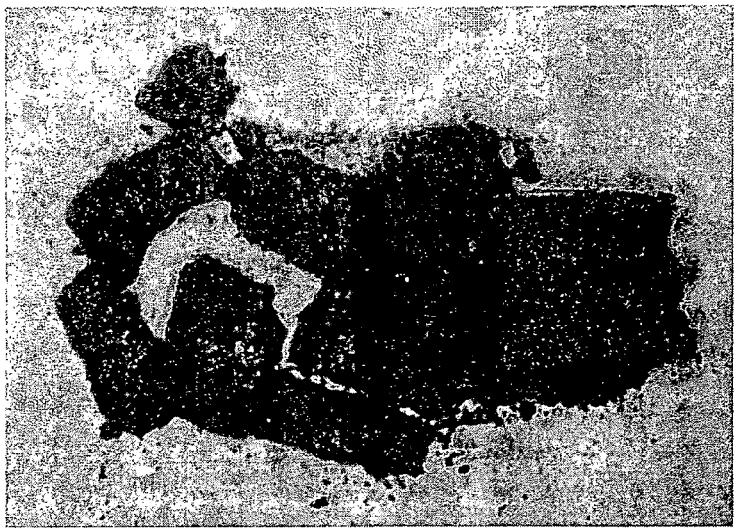
Figure 13C:
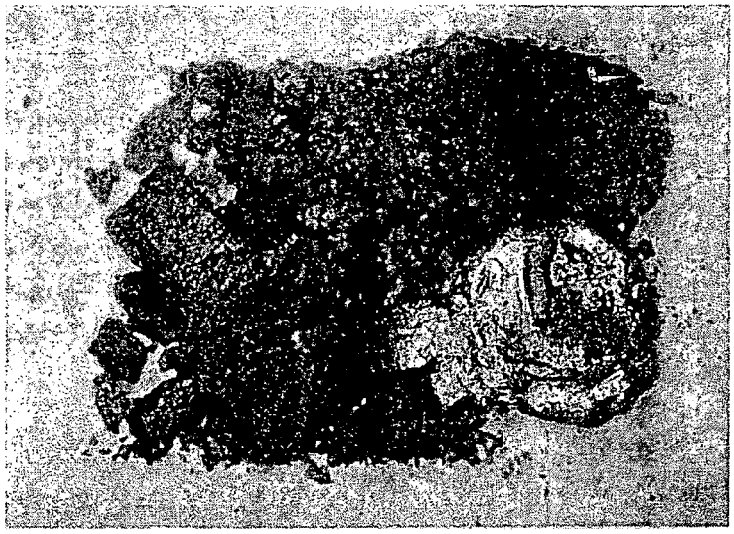

FIGS. 13A–13C show the results for Ex. 6 at 15, 28, and 59% of the reference energy density, respectively. The foregoing photographs show: a) the relatively higher degree of pulverization of Ex. 6 compared with Ex. 5 especially at the higher energy densities; and b) lesser frangibility and pulverization for Ex. 6 compared with the 30% ferrotungsten composition of Ex. 3.

Figure 14A:
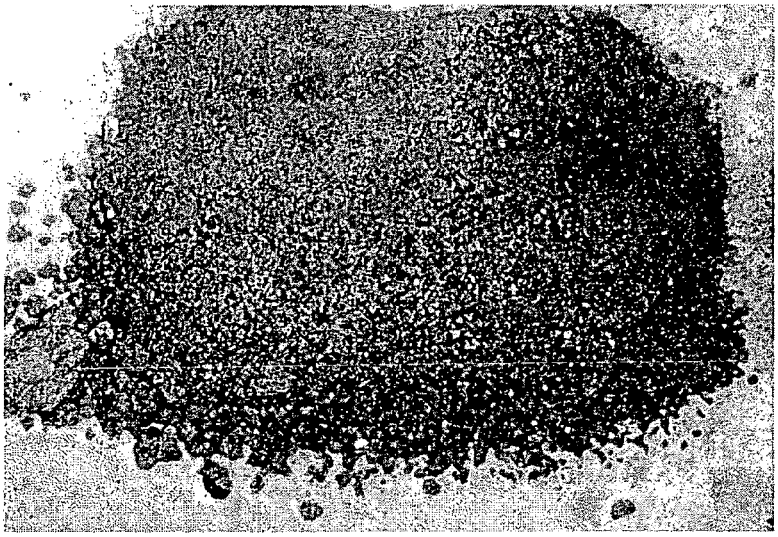
Figure 14B:
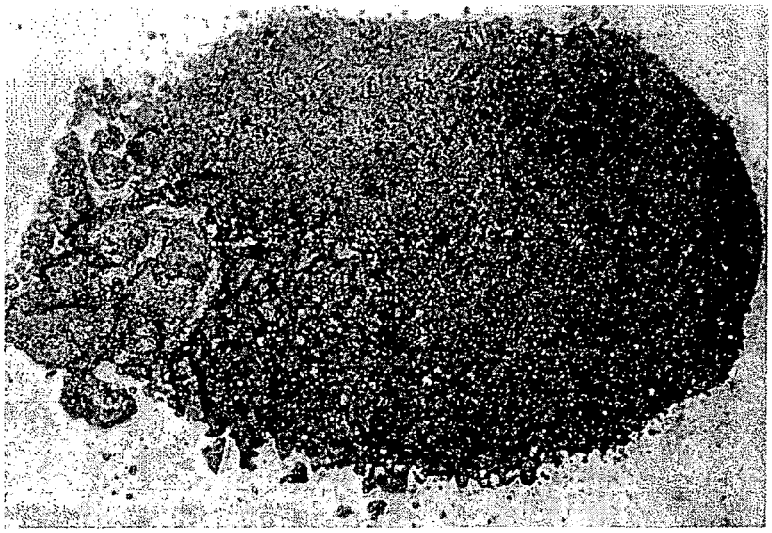
Figure 14C:
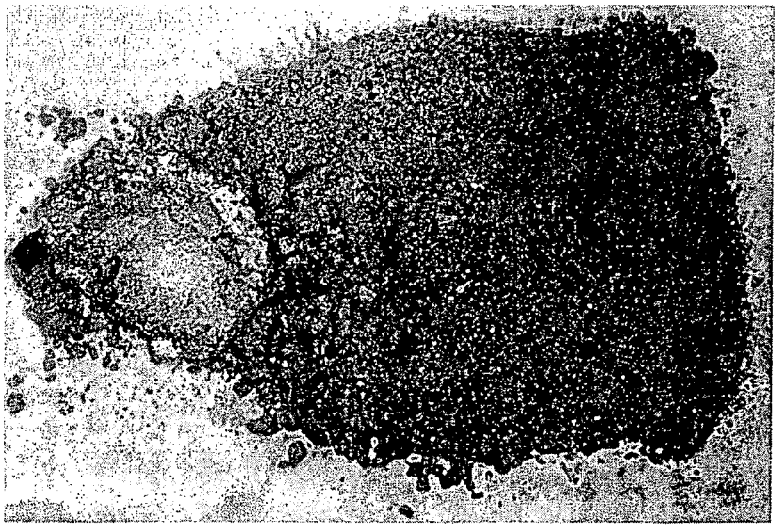

Similarly, FIGS. 14–14C show results for Ex. 7 at energy densities of 17, 34, and 68% of the reference energy density, respectively. This 50% ferrotungsten mix exhibits a high level of frangibility and pulverization across the energy domain.

Figure 15A:
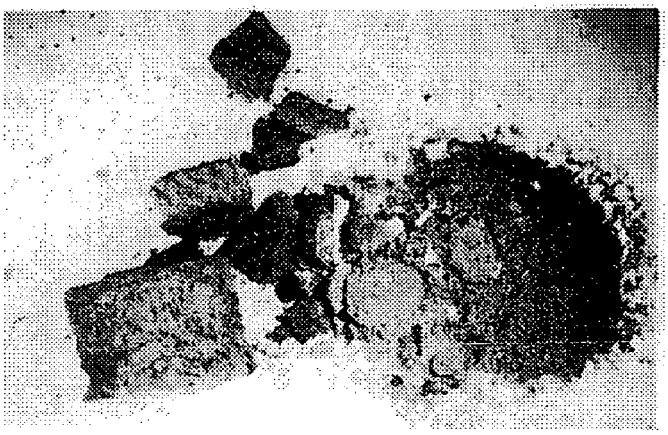
Figure 15B:
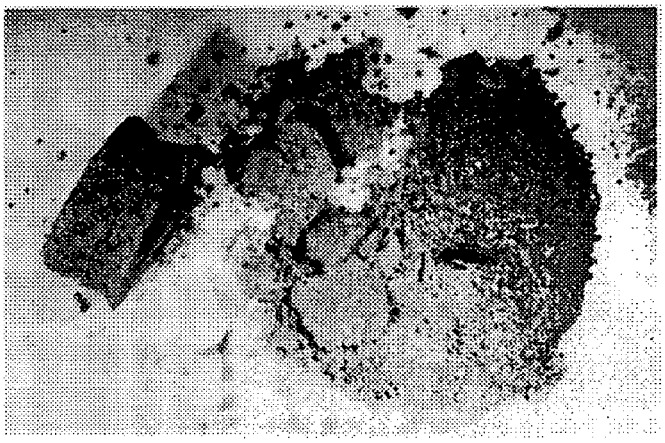
Figure 15C:
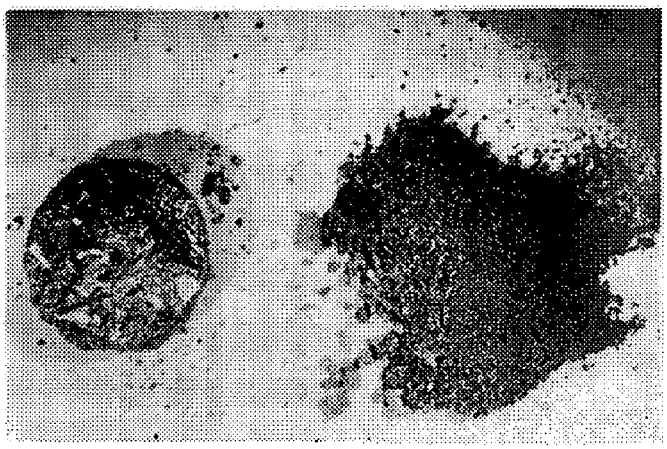

FIGS. 15A–15C show the results for Ex. 8 at 21, 42, and 85% of the reference energy density, respectively.

Figure 16A:
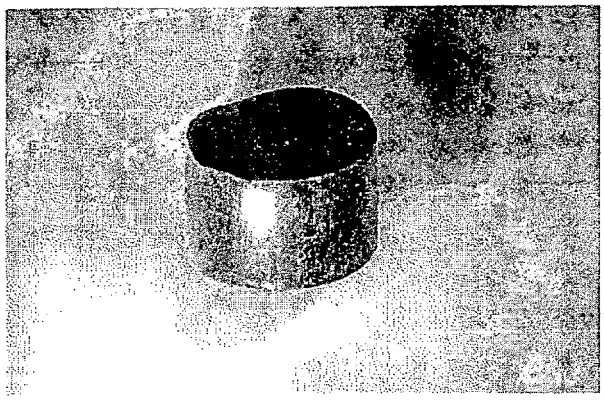
Figure 16B:
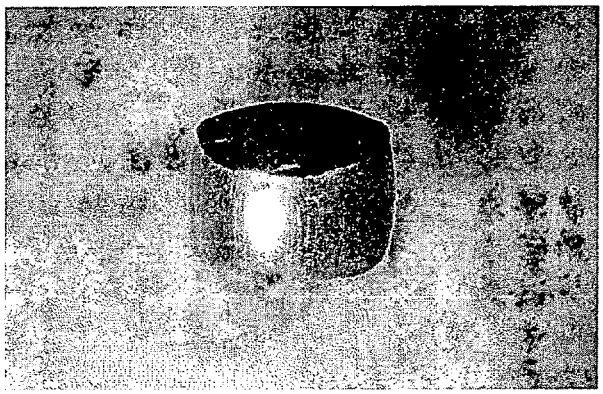
Figure 16C:
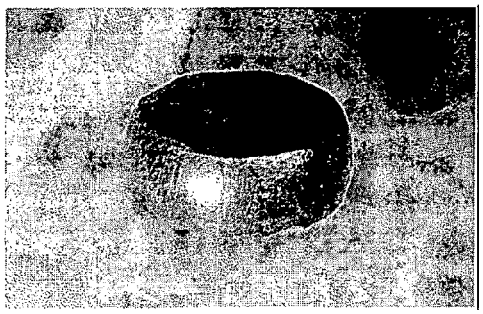

FIGS. 16A–16C show the results for the control at 25, 49, and 97% of the reference energy density, respectively.

Certain of the exemplary slugs of Table 1 were test-fired from an industrial ballistic tool. Table 4 shows ballistic parameters when such slugs were fired from a WINCHESTER RINGBLASTER industrial ballistic tool by Olin Corp. having an overall barrel length of 86 cm (34 inches) and without a rifled extension. A conventional shell was used having a 6.22+/−0.13 g (96+/−2 grain) charge of WMG535 propellant by Primex Technologies, Inc., St. Marks, Fla. The muzzle kinetic energy is simply the kinetic energy of the slug at the muzzle velocity.

TABLE 4

Ballistic Details of Firing Tests

| Ex. | Slug Weight g (oz.) | Chamber Pressure MPa (psi) | Muzzle Velocity m/s (ft/s) | Muzzle Energy J (ft-lb) |
|---|---|---|---|---|
| 1 | 49.3 (1.74) | 1.48 (214) | 621 (2036) | 9496 (7004) |
| 2 | 54.4 (1.92) | 1.68 (244) | 605 (1985) | 9940 (7331) |
| 3 | 58.1 (2.05) | 1.76 (255) | 598 (1962) | 10371 (7649) |
| 4 | 56.1 (1.98) | 1.70 (246) | 598 (1961) | 10025 (7394) |
| 5A | 49.9 (1.76) | 1.52 (221) | 624 (2048) | 9685 (7143) |
| 5B | 49.6 (1.75) | 1.52 (220) | 619 (2032) | 9532 (7031) |

The test firing included firing at a 1.27 cm (0.5 inch) thick non-armor steel plate to observe frangibility and any effect upon the plate. The plate was located approximately 15–16 m (50–53 feet) from the muzzle of the tool. At least one of each of examples 1–5 was fired normal to the plate while certain of the examples were also fired at a plate rotated 30° off normal. Witness paper was located 10.7 m (35 feet) from the muzzle to record the projectile or its fragments passing through the paper both incident to the plate and upon ricochet.

For Ex. 1, five rounds were fired normal to the plate. None penetrated. All left an indentation of between 0.025 cm (0.01 inch) and about 0.089 cm (0.035 inch) in the front of the plate. The back of the plate was substantially unaffected. The witness paper recorded between zero and three pinhole-like punctures in addition to the main incident hole from the slug. In four of the firings, the slug was substantially pulverized with the fifth leaving one large fragment of approximately 0.64 cm by 0.13 cm (0.25 inch by 0.5 inch) in cross-section.

The relatively small indentation (see examples below) indicates a relatively low tendency to damage equipment (e.g., a ladle or kiln wall at which the projectile is fired). The high degree of pulverization indicates a low tendency to produce large fragments which might ricochet and indicates a low tendency to produce large tough fragments which might jam machinery, etc. Additionally, the highly pulverized projectile will readily and quickly be melted, combusted, or the like, and less likely to form a microscopic contaminate in material being processed by a kiln or other apparatus.

Three slugs according to Ex. 2 were also fired normal to the plate. In each case, the plate was indented by about 0.13 cm (0.05 inch), with no penetration. In each case, however, there were multiple pinhole-like punctures in the witness paper and in one case a 0.64 cm by 1.9 cm (0.25 inch by 0.75 inch) hole was observed. The greater indentation indicates a greater propensity to damage equipment than the slugs of Ex. 1. The larger presence of pinhole-like punctures indicates either partial disintegration upon launch or recoil/ricochet of fine fragments upon impact with the target.

With two slugs according to Ex. 3 fired normal to the target, a through-hole was observed in one case with the exit being larger than the entrance. The slug was not observed to have gone through the plate. In the second case there was no through-hole but a large fragment was missing from the back of the plate. In a third firing at 30° off normal, a 0.064 cm (0.025 inch) depression was made in the front of the plate, leaving the back of the plate cracked but otherwise intact. No holes other than the single inherent hole from the incident projectile travelling between the tool and target are present in the witness paper.

Two slugs according to Ex. 4 were fired normal to the plate. In both cases there was a through-hole with a larger exit than entrance. Similarly, the slugs were not observed to have gone through the plate. As with Ex.3, only the single inherent hole was present in the witness paper.

Four slugs according to Ex. 5 (5A) were fired normal to the plate. In each case, there was an approximate 0.13 cm (0.05 inch) depression in the front of the plate with the back cracked and having missing fragments. This indicates a higher degree of plate damage than with the slugs according to Ex.2. In one of the four firings, two small holes were observed in the witness paper. Three such slugs were fired at the plate 30° off normal, each producing an approximate 0.064 cm (0.025 inch) depression on the front side, cracking the back but leaving the back otherwise intact. In each of the three firings, there was a vertical line of holes in the witness paper approximately 0.3 m (one foot) to the right of the main hole indicating partial ricochet of small fragments.

Two more slugs according to Ex. 5 (5B) were fired normal to the plate each leaving an approximately 0.064 cm (0.025 inch) depression in the front of the plate.

A non-armor steel plate has an exemplary yield strength of about 310 MPa (45,000 psi). A slug is advantageously frangible when normally impacted (e.g., discharged from a tool aimed normal to the plate and impacting the plate at a 90° angle to the plate). With an exemplary muzzle kinetic energy of about 9,500 to about 10,400 N-m (7,000–7,700 ft.-lbs.) and a distance from muzzle to target of about 3–20 meters, the slug advantageously breaks apart into a number of pieces. At one relatively minimal level of frangibility the exemplary slug having a weight of about 48–60 g (1.7–2.1 oz.) would break apart upon impact such that the largest residual piece would represent less than about 70 percent of the slug mass. A relatively higher level of frangibility would have that percentage as 50 percent or less, with a yet higher degree of frangibility corresponding to a largest residual piece of no more than 5 percent of the slug mass and resulting in substantial pulverization.

Further firing tests were conducted to attempt to obtain experimental evidence of the degree of frangibility obtained. These were made under similar conditions to the firing tests above and the results are summarized in Table 5. Effort was made to recover the particles left after each firing. The larger particles were weighed individually and remaining particles were sieved with a screen having substantially square openings 0.084 cm (0.033 inch) on a side.

TABLE 5

Slug Breakup in Firing Tests

| | | | Retrieved Mass grams (grains) | | |
|---|---|---|---|---|---|
| Sample | Muzzle Velocity m/s (fps) | Initial Mass grams (grains) | Total | Largest Single Piece | Through 0.084 cm (0.033 in.) screen |
| Unsintered | 714 (2342) | 45.3 (700) | 26.73 (412.5) | 0.03 (0.5) | 26.36 (406.8) |
| | | | 34.84 (537.7) | 0.32 (4.9) | 33.34 (514.5) |
| | | | 34.23 (528.4) | 0.12 (1.8) | 32.96 (508.6) |
| | | | 34.08 (526.0) | 0.05 (0.8) | 33.67 (519.6) |
| Sintered | 705 (2312) | 45.3 (700) | 33.86 (522.6) | 9.05 (139.7) | 19.67 (303.6) |
| | | | 38.30 (591.0) | 7.87 (121.5) | 21.88 (337.6) |
| | | | 37.87 (584.4) | 5.00 (77.2) | 22.83 (352.3) |
| | 746 (2448) | 45.3 (700) | 37.03 (571.5) | 10.68 (164.8) | 19.75 (304.8) |
| | | | 33.55 (517.8) | 9.36 (144.5) | 15.64 (241.3) |
| | | | 37.06 (572.0) | 8.94 (137.9) | 20.55 (317.1) |
| Control 2 | 640 (2101) | 53.3 (822) | 50.87 (785.0) | 32.10 (495.4) | 3.54 (54.6) |
| | | | 48.93 (755.1) | 32.56 (502.5) | 0.84 (13.0) |
| Control 3 | 686 (2250) | 47.4 (731) | 37.97 (585.9) | 12.17 (187.8) | 2.57 (39.6) |
| Control 4 | 650 (2132) | 52.1 (804) | 46.39 (716.0) | 27.10 (418.2) | 1.35 (20.9) |
| | | | 44.97 (694.0) | 26.87 (414.6) | 1.17 (18.0) |

The unsintered slugs were formed of MH-100 iron with 0.8% ACRAWAX C and were pressed to a length of 2.57 cm (1.012 inches) at a diameter of 1.96 cm (0.770 inches). The sintered slugs were formed by sintering the unsintered slugs at a temperature of 650° C. for 15 minutes. The control 2 slugs were formed with 1000A iron and 0.08 ACRAWAX C. They were pressed at 205 MPa (29,770 psi) and sintered at 982° C. for 45 minutes. The control 3 slugs were formed of MH-100 iron and 0.8% ACRAWAX C, compacted at 137 MPa (19,800 psi) and sintered at 927° C. for 15 minutes. The control 4 slugs were formed substituting MH-100 iron in the process used to manufacture the control 2 slugs. The control 2–4 parameters were chosen to approximately simulate extremes of processes involved in U.S. Pat. No. 3,232,233.

The muzzle-to-target distance was approximately 16.8 m (55 ft.) for the unsintered slugs and approximately 15.2 m (50 ft.) for the others, which were tested at an earlier date.

Collecting the slug debris proved difficult. Accordingly, a certain portion of the mass of each slug was unaccounted for. The size distribution of the recovered material can yield significant information regarding the frangibility of the slug. It is seen that the unsintered slugs were essentially pulverized. The largest collected pieces were small fractions of the total mass and the vast majority of material collected passed through the chosen screen. Clearly, somewhere between zero and all of the unaccounted for mass will be in the form of such small particles (e.g., those which would pass through the chosen screen). It is believed that the bulk, if not essentially all, of the unaccounted for mass would be of such small particles. The moderately sintered material (i.e., 650° C. for 15 minutes) also produced a large amount of small particles which would pass through the screen. Even if none of the unrecovered weight were of such small particles, the small particles constituted well over 30% of the initial mass. Were all the unrecovered mass represented by such small particles, their percentage would have been greater than 60% in all cases. Intriguingly, in crush tests (not reported) the unsintered slugs had a slightly higher longitudinal crush strength than did the moderately sintered slugs, while having a moderately lower radial flat plate crush strength. That these crush strengths are even close gives significant encouragement to the use of unsintered or very slightly sintered material when extreme frangibility is advantageous.

The control slugs lacked significant frangibility under the test conditions. Only a very small portion of the unrecovered mass would pass through the chosen screen. Furthermore, the largest recovered piece was typically at least half the initial mass. In one instance where this was not the case, the two largest retrieved pieces (nearly identical in size) accounted for over half the initial mass.

It can also be seen from the tests that random or other factors may cause shot-to-shot/slug-to-slug variation in the distribution of particles upon impact. With this in mind a number of the appended claims identify "typical" or "average" properties which may be satisfied by observations involving a statistically significant sample.

The addition of ferrotungsten to the primary constituent iron both increases slug density and increases slug frangibility as shown by the examples hereinabove. Penalties associated with the use of ferrotungsten include: increased cost due to the relatively high cost of ferrotungsten (compared to iron); and tungsten contamination when used in the iron/steel industry wherein the slug becomes part of the molten metal being processed.

A variety of additions to and substitutes for certain of the materials identified in the examples may be possible. By way of example, subject to the need for or advantages of a higher density projectile, an industrial projectile including copper or copper alloys might be advantageous in some situations. Most notably amongst these situations is for projectiles used in copper smelters. In other applications, alloys such as steel may be substituted for some or all of the powders described, although the expense of steel relative to iron is a penalty to such substitution. The inclusion of tungsten carbide or a more pure tungsten as substitutes for the ferrotungsten described above may also be possible, subject to cost concerns. In such examples, frangibility ranges equivalent to those identified relative to the exemplary compositions are similarly preferred. Other projectile sizes and energy ranges may be utilized. For example, in the aforementioned mining application, a muzzle kinetic energy of in excess of 10850 N-m (8,000 ft.-lbs.), for example about 11120 N-m (8,200 ft.-lbs.), may be advantageous as there may be reduced concern regarding damage to equipment.

Unless noted otherwise, wherever both English and metric units are given for a physical value, the English units shall be assumed to be the original measurement and the metric units a conversion therefrom.

It is apparent that there has been provided in accordance with the present invention a frangible industrial projectile that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A method for manufacturing a frangible slug for firing from an industrial ballistic tool, the method comprising: providing a mixture of powders having a composition that consists essentially of: up to 35 percent ferrotungsten in particulate form, up to 3 percent lubricant, and the balance iron in particulate form and inevitable impurities; compacting said mixture to form a compact; and sintering said compact to form the frangible slug, wherein said content of ferrotungsten increases the density of said frangible slug to provide a frangible slug with a mass that is effective to impart kinetic energy to remove material obstructions from the inside of kilns or furnaces.

2. The method of claim 1, wherein said compacting is performed at a pressure of between about 138 MPa (20,000 psi) and about 827 MPa (120,000 psi).

3. The method of claim 1, wherein said sintering is performed at a temperature no greater than about 900.degree. C.

4. The method of claim 1 wherein said mixture is provided having an amount of ferrotungsten in powder form and an amount of iron in powder form such that the composition of the slug produced after the compacting and sintering is up to about 32% percent ferrotungsten.

5. The method of claim 4 wherein said ferrotungsten in powder form has a particle size distribution such that at least about 40% of such ferrotungsten (by weight) can pass through a 100 mesh sieve having a characteristic opening of 0.15 mm and said iron in powder form has a particle size distribution such that at least 80% of said iron (by weight) can pass through said sieve.

6. The method of claim 5 wherein substantially all of said iron can pass through a second 60 mesh sieve having a characteristic opening of 0.25 mm.

7. The method of claim 1 wherein said iron in particulate form has a particle size distribution such that at least about 85% (by weight) of said iron can pass through a sieve having a characteristic opening of 0.15 mm.

8. The method of claim 1 wherein said iron has a particle size distribution such that from about 20 to 25% of said iron can pass through a sieve having a characteristic opening of 0.045 mm.

9. The method of claim 1 wherein said compacting is performed at pressure effective to form said compact with a transverse rupture strength in excess of 5.5 MPa (800 psi).

10. The method of claim 1 wherein said compacting is performed at pressure effective to form said compact with a transverse rupture strength in excess of 7.24 MPa (1050 psi).

11. The method of claim 1 wherein said sintering is performed for a sintering time of from about 1 minute to about 2 hours at a sintering temperature of from about 500.degree. C. to 900.degree. C. to form the slug.

12. The method of claim 1 wherein said compacting and sintering are effective to provide the slug with sufficient frangibility such that when the slug is expelled from the tool at a muzzle velocity of 640–700 m/s (2100–2400 fps) and normally impacted with a non-armor steel plate having a yield strength of about 310 MPa (45,000 psi) at a distance of about 16 m (53 ft.) from the muzzle, on average a largest residual piece of the slug represents less than 70% of the slug mass and at least 25% of the slug mass is represented by pieces which pass through a 0.084 cm (0.033 inch) sieve.

13. The method of claim 1, further comprising: disposing a sleeve on the slug, said sleeve being formed from a material effective to engage with rifling of the tool and having an inner diameter effective to integrally bond said sleeve to the slug so as to impart spin to the slug when fired from the tool.

14. The method of claim 1, wherein the slug is essentially lubricant-free.

15. The method of claim 1 wherein the slug is dimensioned to be expelled from an eight-gage tool.

16. A method for manufacturing a frangible slug for firing from an industrial ballistic tool, comprising the steps of: providing a mixture having a composition that consists essentially of: metallic powder consisting essentially of up to 35 percent ferrotungsten in particulate form, and the balance iron in particulate form and inevitable impurities, and lubricant; compacting said mixture at pressure effective to thereby forming a compact with a transverse rupture strength in excess of 5.5 MPa (800 psi); and sintering said compact at a temperature no greater than 900° C. to form the frangible slug, wherein said content of ferrotungsten increases the density of said frangible slug to provide a frangible slug with a mass that is effective to impart kinetic energy to remove material obstructions from the inside of kilns or furnaces.

* * * * *